US010393488B2

(12) United States Patent
Whidden, Jr.

(10) Patent No.: US 10,393,488 B2
(45) Date of Patent: Aug. 27, 2019

(54) CARTRIDGE RELOADING DIE ADJUSTMENT DEVICES AND METHODS

(71) Applicant: Johnny L. Whidden, Jr., Nashville, GA (US)

(72) Inventor: Johnny L. Whidden, Jr., Nashville, GA (US)

( * ) Notice: Subject to any disclaimer, the term of this patent is extended or adjusted under 35 U.S.C. 154(b) by 0 days.

(21) Appl. No.: 15/966,303

(22) Filed: Apr. 30, 2018

(65) Prior Publication Data

US 2019/0017793 A1 Jan. 17, 2019

Related U.S. Application Data

(60) Provisional application No. 62/533,157, filed on Jul. 17, 2017.

(51) Int. Cl.
*F42B 33/10* (2006.01)
*F42B 33/00* (2006.01)

(52) U.S. Cl.
CPC ..... *F42B 33/10* (2013.01); *F42B 33/001* (2013.01); *F42B 33/005* (2013.01)

(58) Field of Classification Search
CPC ..... F42B 33/005; F42B 33/10
See application file for complete search history.

(56) References Cited

U.S. PATENT DOCUMENTS

| | | | | |
|---|---|---|---|---|
| 2,600,488 | A | 6/1952 | Crump | |
| 2,629,958 | A * | 2/1953 | Roper | F41A 21/42 42/79 |
| 3,175,456 | A | 3/1965 | Goodsell | |
| 4,869,148 | A | 9/1989 | Tucker | |
| D364,176 | S | 11/1995 | Hartman | |
| 5,649,465 | A | 7/1997 | Beebe | |
| 6,397,720 | B1 | 6/2002 | Fox | |
| 6,412,385 | B1 * | 7/2002 | Willis | F42B 33/10 72/370.13 |
| 9,696,124 | B2 * | 7/2017 | Keska | F42B 33/14 |
| 2015/0159985 | A1 * | 6/2015 | Keska | F42B 33/10 86/24 |

* cited by examiner

*Primary Examiner* — Stephen Johnson
(74) *Attorney, Agent, or Firm* — John G. Posa; Belzer PC

(57) ABSTRACT

Devices and methods facilitate a precise, measured amount of adjustment to a die used for the reloading of ammunition cartridges. A lock ring assembly and notched threads generate audible or tactile user feedback, preferably in the form of "clicks" as the lock ring advances by a precise, predetermined amount axially relative to a die body. The lock ring assembly may be a unified structure, wherein the entire lock ring assembly turns as a unit. In this embodiment, one or more ball detents in the lock ring assembly interact with notched threads on a proprietary die body. Alternatively, the lock ring assembly may be a two-part assembly that can be used with existing threaded dies with continuous un-notched threads. The die body, whether notched or not, may be used in any reloading application in standard presses, including cartridge sizing, crimping, bullet seating, or case mouth belling.

19 Claims, 9 Drawing Sheets

CARTRIDGE RELOADING DIE ADJUSTMENT DEVICES AND METHODS

REFERENCE TO RELATED APPLICATIONS

This application claims the benefit of and priority to U.S. Provisional Patent Application Ser. No. 62/533,157, filed Jul. 17, 2017, the entire content of which is incorporated herein by reference.

FIELD OF THE INVENTION

This invention relates generally to ammunition cartridge reloading and, in particular, to devices that allow a precisely measured amount of adjustment of a die used for cartridge reloading.

BACKGROUND OF THE INVENTION

Virtually all modern firearm ammunition uses a metallic case to hold the elements of the cartridge together before firing. The cartridge case also serves to seal the chamber of the firearm to prevent leakage of the high-pressure gases that result from the burning of the powder charge. Due to the high pressure inside the cartridge case, the case is stretched to fill the full dimensions of the chamber in which it is contained, and the case retains this enlarged size after firing.

Despite this stretching, cartridge cases can be reused. Resizing and other reloading operations are done using dies placed in manually operated presses. Adjustments are made by threading the body of the die up and down in the press. A threaded lock ring is then used to secure and retain the position of the die in the press once a proper adjustment setting is achieved. This adjustment of the die—either toward or away from a ram in the press—is used in most reloading operations, including sizing, forming, and seating of the bullet onto the cartridge case.

Proper die adjustment is critical to the functioning and safety of the reloaded ammunition. Many individuals prefer to adjust their dies to an accuracy of 0.001" (one thousandth of an inch). However, the current state of the art does not allow for such fine adjustments by a measured amount, leaving the individual to adjust the die settings by trial and error. Without a controlled way to thread the dies into and out of the press in precise increments, multiple attempts at the correct adjustment are required until the desired adjustment is reached.

SUMMARY OF THE INVENTION

This invention resides in devices and accompanying methods that facilitate a precise, measured amount of adjustment to a die used for the reloading of ammunition cartridges. This allows a user to easily adjust the die to the proper setting in a controlled manner on the first attempt, without error.

Adjustment apparatus according to the invention includes a lock ring assembly and a structure generates audible or tactile user feedback, preferably in the form of "clicks" as the outer portion of the lock ring assembly is turned, such that with each audible or tactile click, the outer portion of the lock ring advances by a precise, predetermined amount axially relative to the die body.

The precise measured adjustment comes from the interaction between a ball detent and notched threads. The interaction between the ball and the notches gives a clicking sound and/or feel at measured intervals. A lock ring fastener secures the lock ring assembly in position once the desired adjustment is achieved. In certain embodiments, with each audible or tactile click, the lock ring advances by 0.001". However, any number of detents and notches can be used to allow adjustment in any increment desired, including metric displacements.

The lock ring assembly includes an outer portion and an inner portion. The inner portion has internal threads that match the external threads of a threaded die body. In one preferred embodiment, the inner and outer portions of the lock ring assembly define a unified structure, such that the entire lock ring assembly turns as a unit. In this embodiment, one or more ball detents in the lock ring assembly interact with notched threads on a proprietary die body.

In an alternative embodiment, the lock ring assembly is a two-part assembly that can be used with existing threaded dies, including dies with continuous threads that need not be notched. In this embodiment, the inner portion of the lock ring assembly is a separate, inner ring with internal and external threads, and wherein the internal threads of the inner ring match the external threads of an existing threaded die body. The outer portion of the lock ring assembly is a separate, outer ring with internal threads that match the external threads of the inner ring, such that the outer ring turns relative to the inner ring. The structure that generates the audible or tactile feedback is a ball-notch detent system between the inner and outer rings of the lock ring assembly.

In all embodiments, the threaded die body may have a diameter of ⅞" and a pitch of 14 threads per inch. To increase notch spacing, a plurality of detents may be used in either the one-part or two-part lock ring assembly. The ball detent(s) in the lock ring assembly may include a coil spring or compressible, resilient material that urges the ball toward the notched threads. The die body, whether notched or not, may be used in any reloading application, including cartridge sizing, crimping, bullet seating, or case mouth belling.

DETAILED DESCRIPTION OF THE PREFERRED EMBODIMENTS

Figure 1:
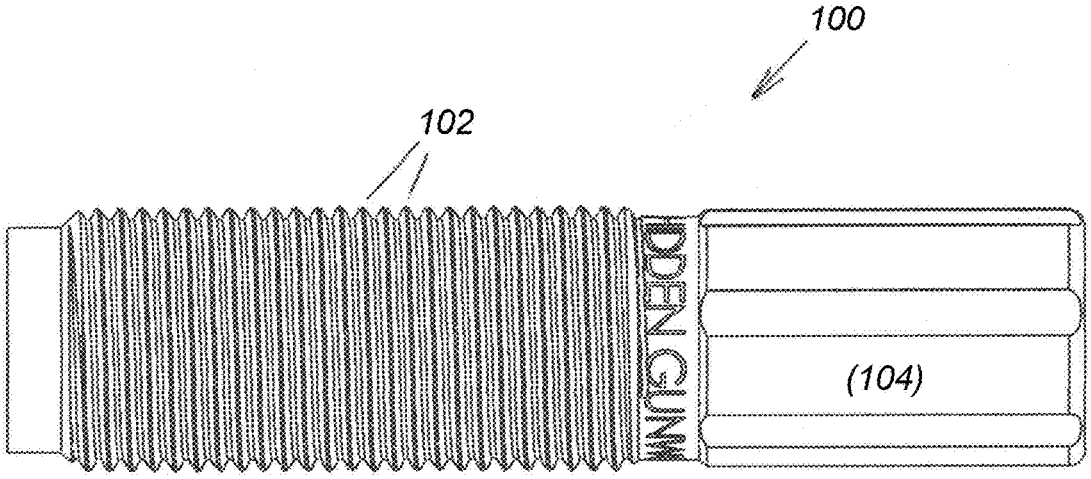
Fig. 1 (PRIOR ART)
FIG. 1 shows the outside of a standard, prior-art reloading die.
Figure 2:
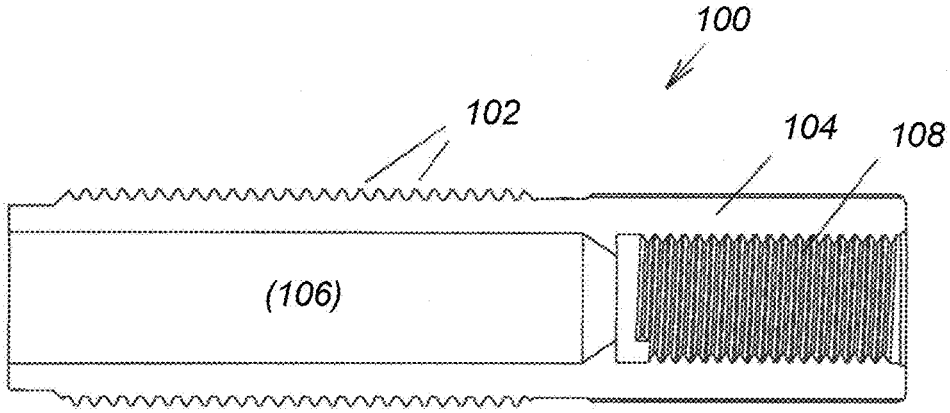
Fig. 2 (PRIOR ART)
FIG. 2 is a cutaway view of the standard reloading die of FIG. 2.

FIG. 1 shows the outside of a standard reloading die at 100 including threads 102 on the outside of the die body 104. Note that the threads on die body are not notched or otherwise modified to facilitate measured adjustment. FIG. 2 shows a cutaway view of the die. The chamber 106 shown in the center of the die in this case is typically used for the sizing of a brass cartridge case, but can have other uses as well such as bullet seating or crimping through appropriate dimensional modification. Internal threads 108 are used to receive various components associated with different operations; for example, separate, replaceable bushings that controls the amount that the neck is sized.

The die is adjusted by threading the die 100 into a reloading press using the external threads 102. Using die sizing as an example, when the die is threaded toward the press ram, more sizing is done due to the tapered nature of the inside of the die. Likewise, less sizing is allowed as the die 100 is threaded away from the press ram. After a trial-and-error adjustment process, a conventional lock nut is moved along threads 102 to maintain the die body with respect to the press ram.

Figure 3:
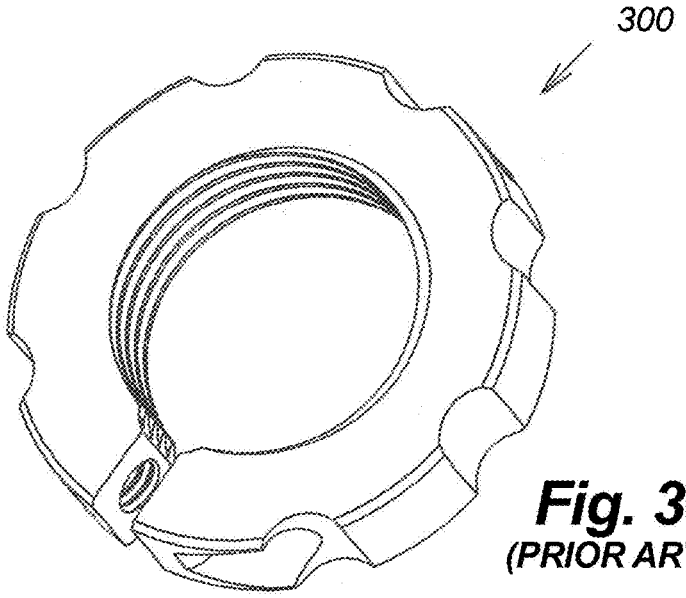
Fig. 3 (PRIOR ART)
FIG. 3 shows a lock ring used on the threads of a conventional reloading die.

FIG. 3 shows a typical lock ring 300 used on the threads of a conventional die. The die is threaded into the reloading press up to this lock ring, which is secured to the die and typically left in place. This serves to allow changing dies in the reloading press without having to readjust each individual die every time it is removed and reinstalled in the press.

Figure 4:
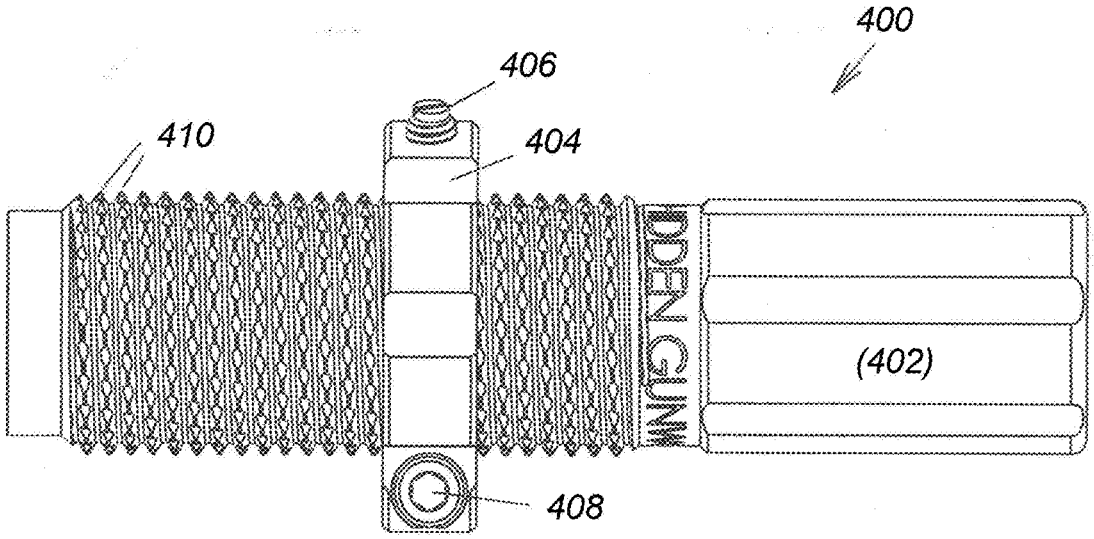
FIG. 4 is a drawing that illustrates an ammunition reloading adjustment device according to the invention.

FIG. 4 illustrates an adjustment device 400 according to the invention, which includes an elongated cylindrical die body 402, lock ring 404, and a ball spring plunger (detent) 406. Lock ring screw 408 shown at the bottom is used to secure the lock ring 404 once the desired adjustment had been reached. The ball detent 406 is shown protruding from the lock ring 404 at the top. The lock ring 404 surrounds the threaded portion of the die and is threaded internally to engage the threads of the die, allowing adjustment up and down the die body, much like a conventional lock nut. Note that threads 410 are standard threads, they have been modified to cooperate with the inventive lock nut shown in FIG. 3.

Figure 5:
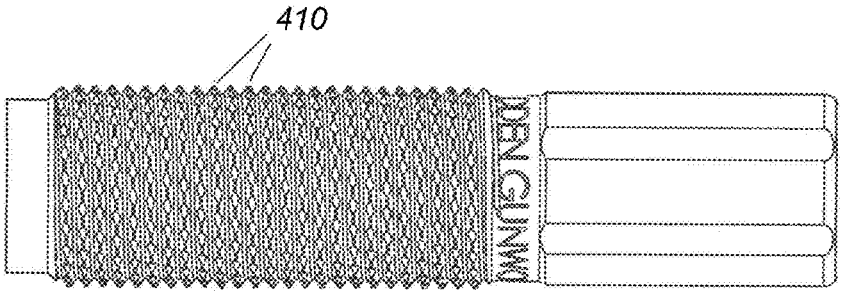
FIG. 5 shows a die with modified threads associated with the inventive measured adjustment system.

FIG. 5 illustrates the inventive measured adjustment system with the lock ring 404 removed. The threads 410 have small notches cut into them to allow the ball detent ball (or similar device) to drop into each notch. This action gives a 'clicking' feel and/or sound. The components described herein are made of a metal such as steel, and the notches are machined through precise numerical control.

Figure 6:
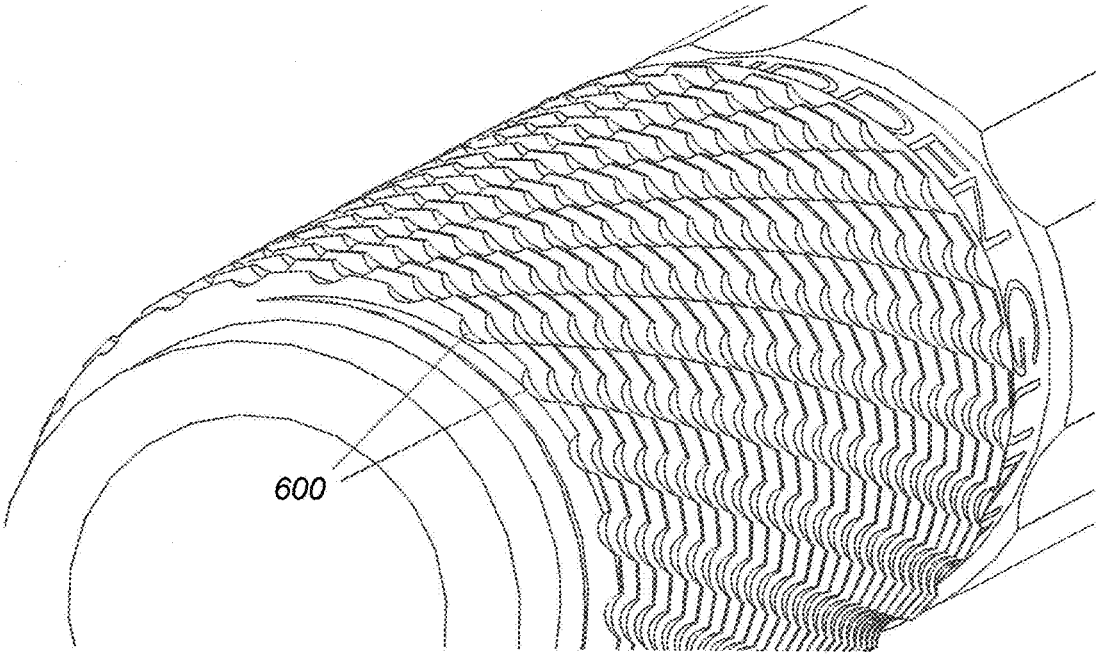
FIG. 6 is a view of notches formed in the threads of the die.
Figure 7:
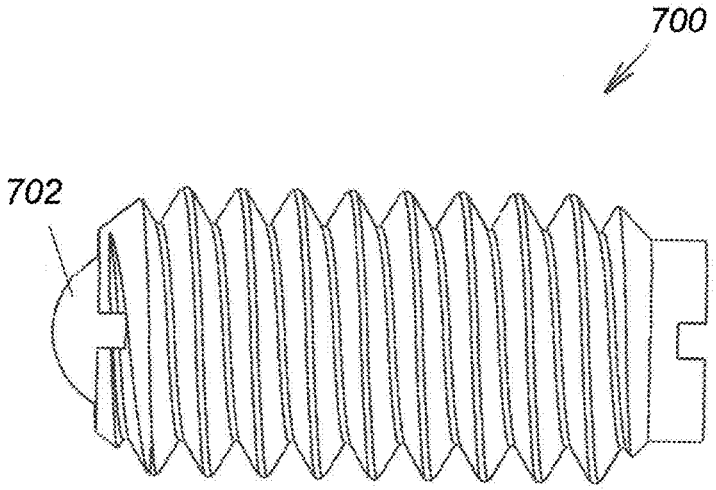
FIG. 7 illustrates a ball-spring plunger.

FIG. 6 is a more detailed, oblique view of the notches 600 cut into the threads, and FIG. 7 shows a ball spring plunger detent 700 according to the invention. The device shown in FIG. 7 is installed into the lock ring 404, and provides the clicking action. This device contains a spring behind the ball 702 that is shown on the left end of the plunger 700. The ball can move against this spring.

Figure 8A:
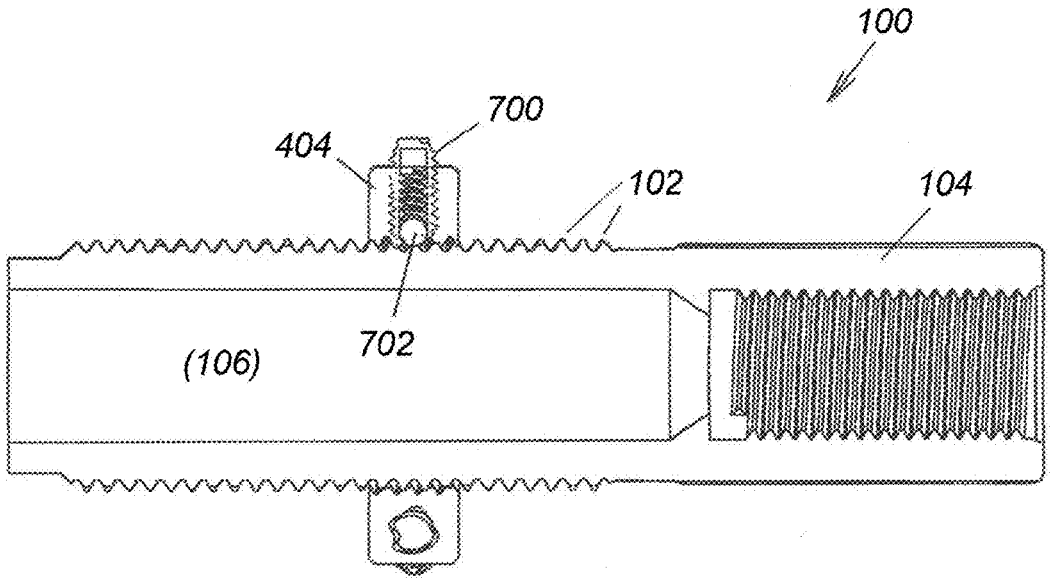
FIG. 8A is a cutaway view of an entire assembly.
Figure 8B:
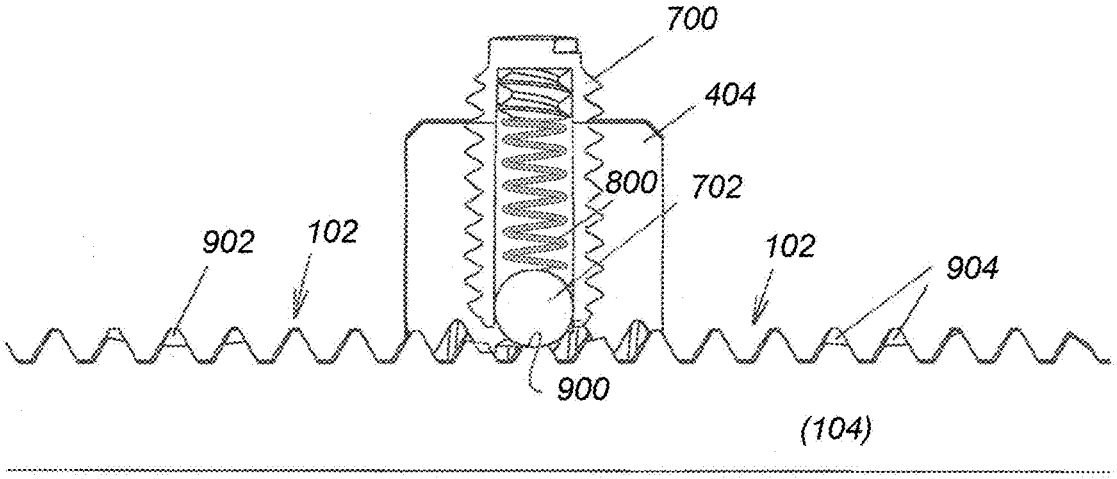
FIG. 8B is a drawing that shows the ball-spring plunger and notches on the threads in greater detail.

FIG. 8A shows a cutaway view of the entire assembly. The die body 104 is in the center and the lock ring 404 containing the ball detent is surrounding it. As the lock ring is turned on the die threads, the ball spring plunger will drop into the notches on the threads, giving a clicking feel and sound and measured adjustment of the die. FIG. 8B shows a ball detent and notches on the threads in greater detail. Ball 702, urged by spring 800, has dropped into notch 900 cut into the threads 102 on the die body. Other notches are depicted at 902, 904.

The preferred embodiment of the invention gives the user a feel and/or sound of each increment of adjustment. Most users in the U.S. use the English system of measurement, and will adjust their reloading die in increments of one thousandth of an inch. Thus, in one implementation, the geometry is such that each click results in a 0.001" advance along the die body. Three "clicks" informs the user that the lock ring has advanced three thousands of an inch, and so on.

While engineering the invention, it was found that a ring with a single ball detent would require a very small ball size and corresponding notches on the threads of the die that are too closely spaced apart to be practical. The threads of a standard reloading die are ⅞-14; that is ⅞" in diameter, and 14 threads to the inch. Fourteen threads to the inch, or about 0.07143", divided by 1/1000" or 0.001", results in about about 72 increments per thread. With a standard shaft diameter of ⅞" or 0.875", this would require notches spaced apart by about 0.012 inches, or less that 1/64" (actually about 1/83"). Machining to this tolerance would require a very small detent ball diameter and notches, resulting in unnecessarily precise machining and delicate aural/tactile feedback.

As such, while it is possible to use a single ball detent per ring, the number of ball detents in the ring may be increased to reduce the required number of notches per thread. In one configuration, three detents are used per ring, which divides the number of notches required with a single detent by 3, resulting in 72/3 or only 24 notches per thread, which is more manageable in terms of machining, and allows larger balls to be used with enhanced aural/tactile feedback.

FIG. 10A is a simplified drawing that shows three ball detents, 1002, 1004 and 1006, spaced apart around a ring (not shown), that cooperate with 24 notches 1108 around body 1110, which has standard ⅞-14 die threads. The axes of the ball plungers are spaced apart at angles such that the balls drop into the notches in consecutive order but not at the same time. The angular spacing may be varied somewhat, so long as the angle between the plungers is not 7.5 degrees (180/24). In one configuration, the angle between the detents is 7.5+2.5 degrees and 7.5−2.5 degrees. Note that the detents are also axially offset in the lock ring such that all of the ball plungers are helically aligned with the pitch of the threads.

Figure 9A:
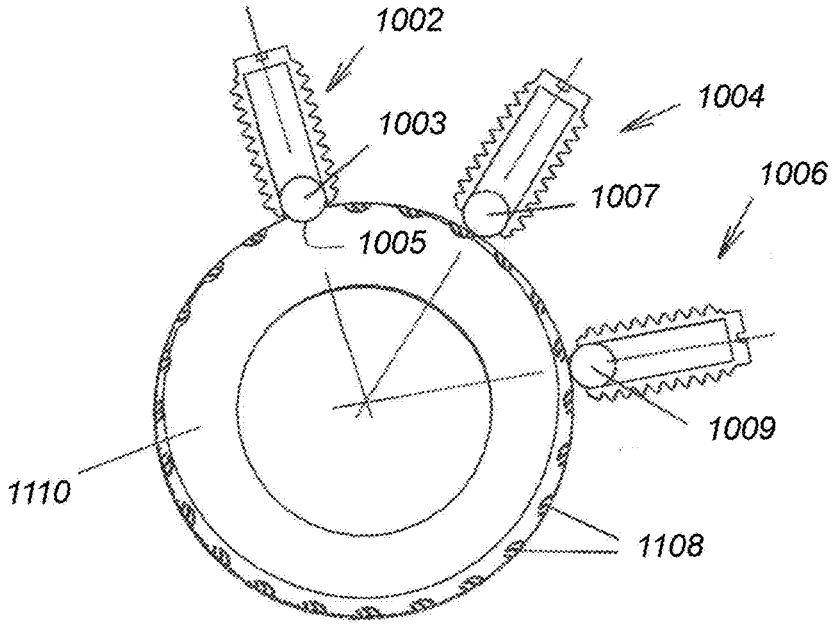
FIG. 9A is a simplified partial cross section that shows how multiple detent may be used in a ring to reduce the number of notches in the threads of the die.
Figure 9B:
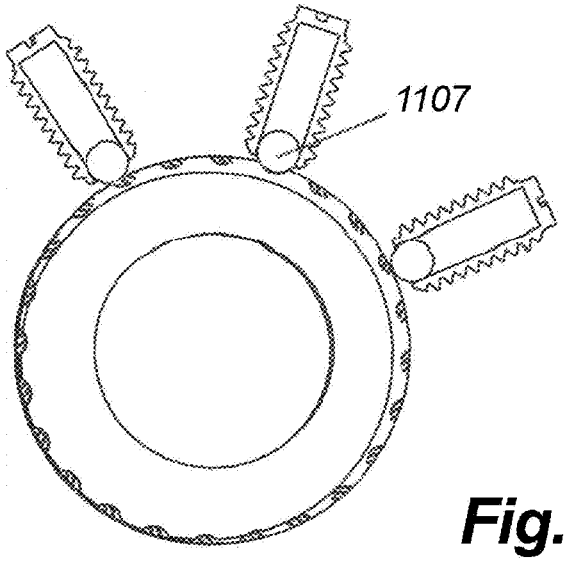
FIG. 9B shows the ring of FIG. 9A rotated to advance the ring by a predetermined amount.
Figure 9C:
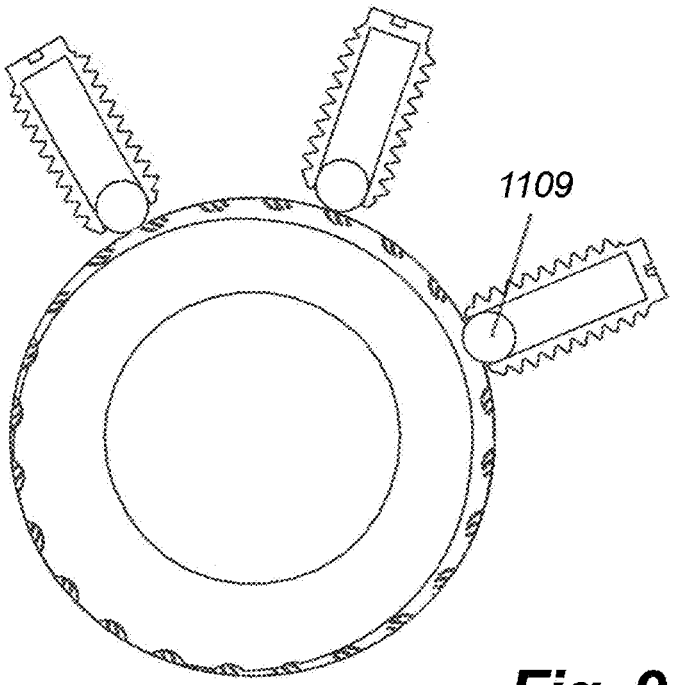
FIG. 9C shows the ring of FIG. 9A rotated again to advance the ring by the same predetermined amount.

As shown in FIG. 9A, plunger 1002 causes ball 1003 to drop into a first notch 1005 (resulting in a "click"). Balls 1007 and 1009 ride on the thread edges and are not received by notches. However, as shown in FIG. 9B, with a turn of the ring advancing the die by 1/1000", ball 1007 now falls into a notch, resulting in the next click. Continuing, with another turn and 1/000" advancement, ball 1009 drops into a notch, as shown in FIG. 9C.

While in the embodiment just described there are three detents and approximately 24 notches on the circumference of the die, it will be appreciated that any number of detents and notches can be used to allow adjustment in any increment desired, including metric displacements. Moreover, as opposed to separate and independent ball detents, one spring may provide spring pressure to multiple detents. Such an embodiment could use one or more curved springs or leaf springs as well as one or more coil springs. A disc-shaped detent and spring may be located at the top or bottom of the die rather than in the lock ring. As a further alternative, notches may be formed in the lock ring, with the detents on the die body. A spring may be used with no detents or balls, such that the spring interacts directly with the notches to produce the clicking sound, or feel, or both.

Figure 10:
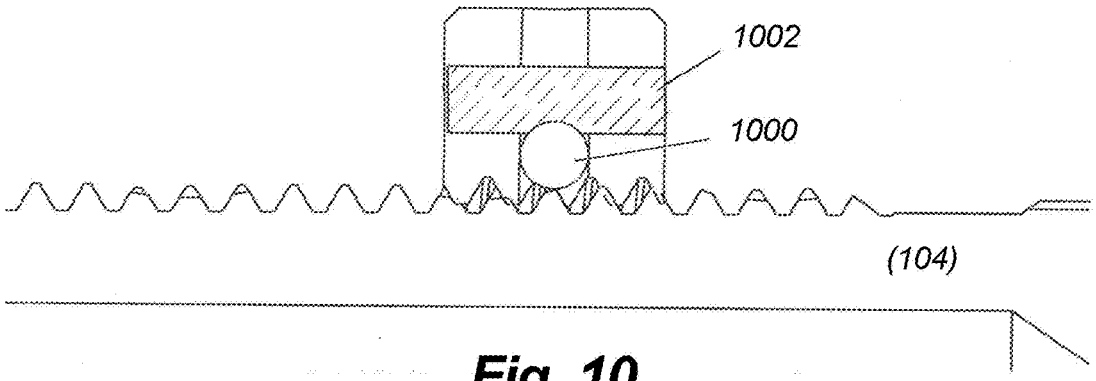
FIG. 10 shows details of an alternative embodiment of the invention that uses a compressible, resilient rubber or rubber-like material instead of a coil spring.
Figure 11:
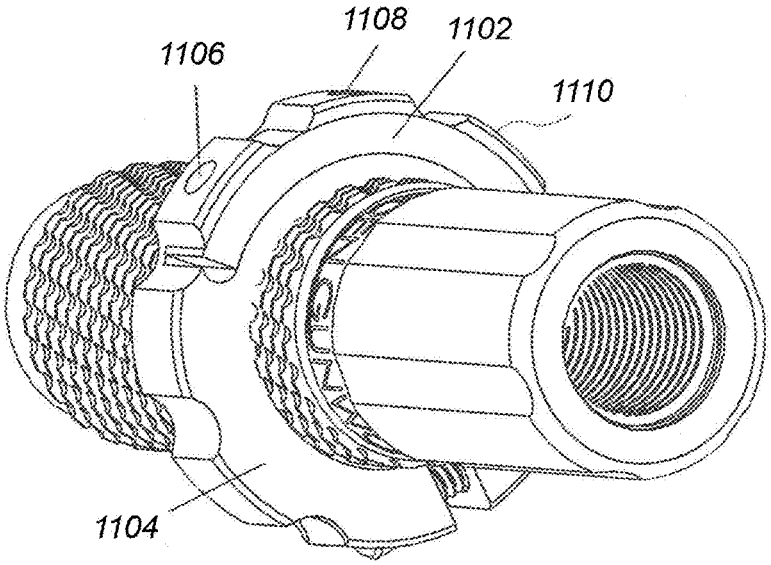
FIG. 11 depicts the use of a single spring to urge multiple ball detents.

As an alternative to the use of a coil spring, a compressible, resilient material such as rubber or rubber-like material may be used. FIG. 10 is a cross section that provides details of this alternative embodiment, including a ball 1000 with a rubber "spring" 1002 that provides pressure and urges the ball 1000 into the notches. The rubber spring causes the ball to ride into and out of the detent notches, giving the clicking feel and/or sound. As with other embodiments described herein, more than one of the devices shown in FIG. 10 may be used per ring. FIG. 11 shows an embodiment wherein one rubber spring 1102 is used to provide pressure to three balls. The balls are not visible, but are loaded through apertures 1106, 1108, 1110. The material 1102 is shown in the lock ring 1104.

In an alternative preferred embodiment, both the detents and notches are present in the lock ring (or lock rings), allowing the device to be used on existing dies which do not have notches already cut into them. FIG. 12 details such an embodiment, which involves a two-part construction; namely, an inner ring 1202 that features standard inner threads 1204 (such as ⅞-14), and an outer ring 1206 that includes a lock ring fastener 1208. The inner ring 1202 includes its own fastener 1210 that locks the inner ring to the standard threads of the existing die body.

Figure 12C:
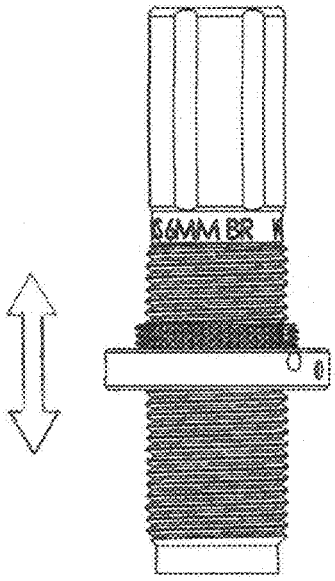
FIG. 12C shows how the outer ring of the two-part system of FIGS. 12A, B, moves in clicking increments relative to the inner ring.
Figure 12A:
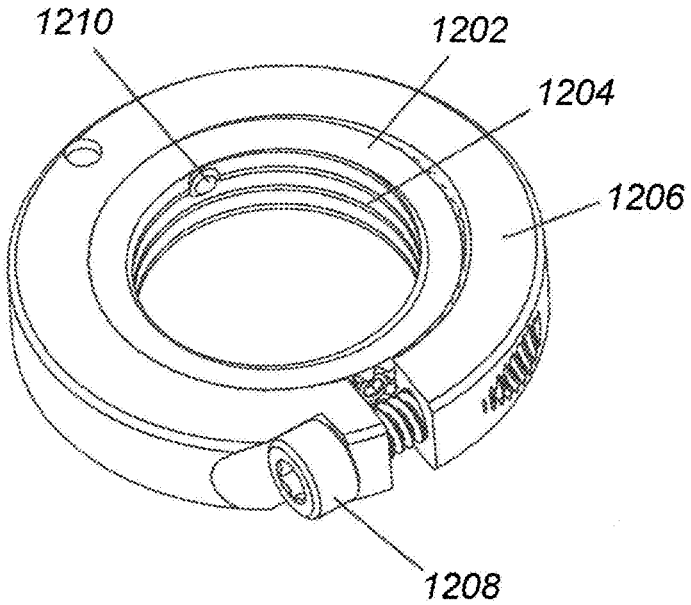
FIG. 12A illustrates a further embodiment of the invention comprising a two-part ring that accommodates existing die bodies with un-notched threads.
Figure 12B:
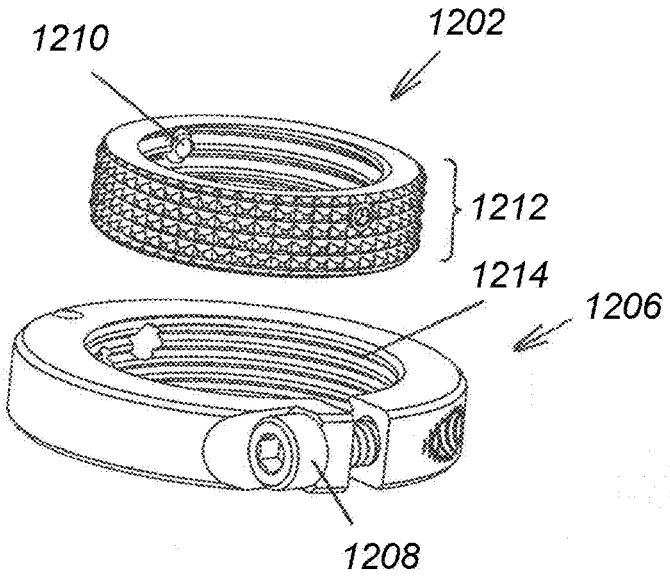
FIG. 12B is an exploded view of the two-part system of FIG. 12A.

As shown in the exploded view of FIG. 12B, a cooperating clicking mechanism is provided between the outer surface of the inner ring 1202 and the inner surface of the outer ring 1206. In particular, the outer surface of the inner ring 1202 includes notched threads 1202, and the inner surface of the outer ring includes threads 1214 that match the threads of 1212 of the inner ring. The outer ring 1206 also includes a detent system with one or more balls that drop into the notches cut into the threads 1212 on the outer surface of the inner ring 1202.

The embodiment of FIG. 12 has several advantages, not the least of which is that it allows the specialized two-part ring of FIG. 12A, B to be used with virtually any existing threaded die to impart a clicking sound or feel at virtually any predetermined increment upon rotation of outer ring 1206 relative to inner ring 1202. Another advantage, however, is that the cooperating threads between the inner and outer rings 1202, 1204, can be any convenient thread size, and need not be limited to the 14 threads per inch of a standard die. The diameter of the inner ring is also larger than the ⅞" of the standard die, allowing for more versatility in terms of the number of notches per thread and detents per ring. As one example, a 1" diameter/20 threads per inch structure may be used between the inner and outer rings with a single detent, resulting in 50 notches per thread. Broadly speaking, if the thread structure between the inner and outer rings is defined as the diameter and pitch, both in inches, and 1000 divided by this thread structure is an integer, the notches may be symmetrically stacked in a regular annular array to achieve 0/001" clicks, as perhaps best seen in FIG. 12B.

In use, the inner ring 1202 is positioned on an existing die body at a nominal distance from the end of the die that would be used in conjunction with a desired reloading operation. For example, the inner ring may be placed at a predetermined distance associated with a particular sizing operation, at which point the inner ring is locked onto the die body with set screw 1210. The outer ring 1206 is then threaded onto the inner ring and moved up and down on the inner ring as shown in FIG. 12C for precise adjustments in a manner identical to the previously described embodiments; that is, with each clicking movement of the outer ring representing a predetermined adjustment of 1/1000" from the nominal initial placement of the inner ring. Once the desired adjustment is achieved, the outer ring 1206 is locked against inner ring 1220 with fastener 1208.

The clicking lock ring will be used differently depending on the type of reloading press being used. In the most common type of press, the O-Frame style, the position of the die is set by turning the die down into the press until the bottom of the lock ring stops against the press. When used in this type of press, adjustment is made by turning the outer lock ring 1206 downward around the inner ring 1220. The die and lock ring together will be unscrewed from the press, then the user will click the outer ring 1206 downward toward the press, and when reinstalled into the press the height of the die and therefore the adjustment of the die will be changed by the desired measured amount.

The invention will work differently when used in a press that retains the die only by holding the lock ring in a slot such as a Forster Co-Ax press. In these slotted presses, the die is not threaded into the press but rather the die and lock ring are inserted into a slot in the press. The height of the die, and therefore the adjustment, are controlled by the top of the lock ring. To adjust the clicking lock ring in this press, the die is first removed from the press. The outer ring 1206 will be adjusted upward around the inner ring 1220. When reinserted into the press the die will now be lowered by the desired measured amount.

This invention is applicable to all types of cartridge reloading dies including sizing dies, seating dies, crimp dies and belling dies. The invention can also be applied to adjustments within the die itself such as the seating depth adjustment of a seating die, the belling adjustment of a belling die, and other applications.

The invention claimed is:

1. Adjustment apparatus for ammunition cartridge reloading, comprising:

a lock ring assembly including an outer portion and an inner portion, and wherein the inner portion has internal threads that match and engage with external threads of a threaded die body having a longitudinal axis;

a structure that generates audible or tactile clicks as the outer portion of the lock ring assembly is turned, such that with each of the audible or tactile clicks, the outer portion of the lock ring advances by a precise, predetermined amount axially on the die body; and a lock ring fastener that secures the lock ring assembly in position on the die body once the desired adjustment is achieved.

2. The adjustment apparatus of claim 1, wherein with each audible or tactile click, the lock ring advances by 0.001".

3. The adjustment apparatus of claim 1, wherein the inner and outer portions of the lock ring assembly define a unified structure, such that the entire lock ring assembly turns as the outer portion is turned.

4. The adjustment apparatus of claim 3, wherein:

the external threads of the threaded die have a plurality of spaced-apart notches; and the structure that generates the audible or tactile clicks is a ball detent in the lock ring assembly that engages with the notches in the threads of the die body.

5. The adjustment apparatus of claim 4, including a plurality of spaced-apart ball detents on the lock ring assembly that engage with the notches in the threads of the die body.

6. The adjustment apparatus of claim 5, wherein the threaded die body has a diameter of ⅞" and a pitch of 14 threads per inch.

7. The adjustment apparatus of claim 6, wherein:

the lock ring assembly includes three spaced-apart ball detents, only one of which engages with a notch in the threads at a given time; and the threaded die body has 24 notches per each thread, such that with each audible or tactile click, the lock ring assembly advances by 0.001" axially relative to the die body.

8. The adjustment apparatus of claim 4, wherein the ball detent in the lock ring assembly includes a ball and a coil spring or compressible, resilient material that urges the ball toward the external threads of the die body.

9. The adjustment apparatus of claim 4, wherein the notched threads are on a first end of the die body, and wherein the first end of the die body includes an internal bore adapted to receive an ammunition cartridge; and the die body includes an opposing, second end that includes internal threads adapted to receive an insert configured for use in conjunction with a specific cartridge reloading operation.

10. The adjustment apparatus of claim 9, wherein the specific reloading cartridge operation is cartridge sizing, crimping, bullet seating, or case mouth belling.

11. The adjustment apparatus of claim 1, wherein:

the lock ring assembly is a two-part assembly;

the inner portion of the lock ring assembly is a separate, inner ring with internal and external threads, and wherein the internal threads of the inner ring match the external threads of an existing threaded die body; and the outer portion of the lock ring assembly is a separate, outer ring with internal threads that match the external threads of the inner ring, such that the outer ring turns relative to the inner ring.

12. The adjustment apparatus of claim 11, wherein the internal threads of the inner ring are ⅞"-14 threads.

13. The adjustment apparatus of claim 11, wherein the structure that generates audible or tactile clicks is a ball-notch detent system between the inner and outer rings of the lock ring assembly.

14. The adjustment apparatus of claim 13, wherein:

the external threads of the inner ring are notched; and the outer ring has a ball detent that engages with the notches on the external threads of the inner ring.

15. The adjustment apparatus of claim 11, including two lock ring fasteners, one that locks the inner ring on the threaded die body, and another that locks the outer ring to the inner ring.

16. The adjustment apparatus of claim 11, wherein with each audible or tactile click, the outer ring advances by 0.001" axially relative to the inner ring.

17. The adjustment apparatus of claim 11, wherein:

the thread structure between the inner and outer rings is defined as the diameter and pitch in inches; and 1000 divided by the thread structure is an integer.

18. The adjustment apparatus of claim 17, wherein the thread structure is 1"-20 threads.

19. The adjustment apparatus of claim 11, wherein the existing threaded die body is adapted for use in cartridge sizing, crimping, bullet seating, or case mouth belling.

* * * * *